US008789241B2

(12) United States Patent
Collene

(10) Patent No.: US 8,789,241 B2
(45) **Date of Patent: *Jul. 29, 2014**

(54) BREAKAWAY HINGE RECEPTACLE

(71) Applicant: Mansfield Assemblies Co., Mansfield, OH (US)

(72) Inventor: James J. Collene, Bucyrus, OH (US)

(73) Assignee: Mansfield Assemblies Co., Mansfield, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/674,453

(22) Filed: Nov. 12, 2012

(65) Prior Publication Data

US 2013/0067685 A1 Mar. 21, 2013

Related U.S. Application Data

(63) Continuation of application No. 12/512,371, filed on Jul. 30, 2009, now Pat. No. 8,307,504.

(60) Provisional application No. 61/116,088, filed on Nov. 19, 2008, provisional application No. 61/085,196, filed on Jul. 31, 2008.

(51) Int. Cl.
*E05F 1/08* (2006.01)

(52) U.S. Cl.
USPC ..... 16/286

(58) Field of Classification Search
USPC ..... 16/286, 287, 257, 260, 261, 263, 323, 16/324; 126/191, 192, 194, 198, 197; 49/386, 389
See application file for complete search history.

(56) References Cited

U.S. PATENT DOCUMENTS

| | | | | | |
|---|---|---|---|---|---|
| 3,067,736 | A * | 12/1962 | Barefoot | 126/194 |
| 3,712,287 | A * | 1/1973 | Summers, Jr. | 126/191 |
| 3,955,865 | A * | 5/1976 | Wilson | 126/191 |
| 4,001,973 | A * | 1/1977 | Rice et al. | 49/386 |
| 4,194,321 | A * | 3/1980 | Hess | 49/389 |
| 4,315,495 | A * | 2/1982 | Jellies | 126/194 |
| 4,665,892 | A * | 5/1987 | Spargo et al. | 126/194 |
| 5,291,634 | A | 3/1994 | Zanetti | |
| 5,341,542 | A | 8/1994 | Hannan et al. | |
| 5,937,481 | A * | 8/1999 | Faringosi | 16/332 |
| 6,892,424 | B1 | 5/2005 | Habegger et al. | |
| 7,017,232 | B1 | 3/2006 | Priddy | |
| 7,150,071 | B2 * | 12/2006 | Collene et al. | 16/289 |
| 8,201,304 | B2 | 6/2012 | Steurer et al. | |
| 2006/0032019 | A1 * | 2/2006 | Kistner et al. | 16/286 |
| 2010/0212112 | A1 | 8/2010 | Steurer et al. | |

* cited by examiner

*Primary Examiner* — Chuck Mah
(74) *Attorney, Agent, or Firm* — Fay Sharpe LLP

(57) ABSTRACT

A breakaway hinge receptacle includes a base including first and second hinge arm mounting structures. The second hinge arm mounting structure is movable between an operative position and a breakaway position. A breakaway lever is connected to the base and includes inner and outer ends, wherein the inner end is operatively engaged with the second hinge arm mounting structure. A spring is operatively engaged between the breakaway lever and the base. The spring biases the breakaway lever to a first position in which the inner end of the breakaway lever biases the second mounting structure to its operative position. The second hinge arm mounting structure is selectively movable from its operative position to its breakaway position against the biasing force exerted by the inner end of said breakaway lever and the spring. Alternatively, the second hinge arm mounting structure is defined by or is connected to or is otherwise included on the inner end of the breakaway lever.

22 Claims, 17 Drawing Sheets

BREAKAWAY HINGE RECEPTACLE

CROSS-REFERENCE TO RELATED APPLICATIONS

This application is a continuation of U.S. application Ser. No. 12/512,371 filed Jul. 30, 2009 (Jul. 30, 2009) which claims priority from and benefit of the filing date of both: (i) U.S. provisional patent application Ser. No. 61/116,088 filed Nov. 19, 2008 (Nov. 19, 2008); and, (ii) U.S. provisional patent application Ser. No. 61/085,196 filed Jul. 31, 2008 (Jul. 31, 2008), and the entire disclosure of each of said prior applications is hereby expressly incorporated by reference into the present specification.

BACKGROUND

Oven, dryer, and other appliance manufacturers sometimes desire to equip the appliance with a "breakaway" hinge system such that excessive weight placed on the open door of the appliance will cause the door to "breakaway" or collapse such that the door moves beyond ninety degrees to vertical rather than cause the entire appliance to tip. In some cases, a stop is provided to limit breakaway movement and in others the door is allowed to pivot until it contacts the floor or other support surface supporting the appliance. Depending upon the exact design of the breakaway mechanism, the door breakaway condition can self-reset such that removal of the excessive weight from the appliance door will allow the door to return automatically to its operative position (so as to lie in a plane that is oriented about 90 degrees to vertical), or the door breakaway condition can be made persistent and thus require a manual reset of the breakaway mechanism by the appliance user or a service technician before the appliance door is again ready for use.

Known appliance door breakaway systems have been deemed to be sub-optimal for a wide variety of reasons, including cost, complexity, performance, size, and the like. As such, it has been deemed desirable to provide a new appliance door breakaway system that overcomes the above-noted deficiencies and others associated with known systems.

SUMMARY

In accordance with one aspect of the present development, a breakaway hinge receptacle includes a base including first and second hinge arm mounting structures. The second hinge arm mounting structure is movable between an operative position and a breakaway position. A breakaway lever is connected to the base and includes inner and outer ends, wherein the inner end is operatively engaged with the second hinge arm mounting structure. A spring is operatively engaged between the breakaway lever and the base. The spring biases the breakaway lever to a first position in which the inner end of the breakaway lever biases the second mounting structure to its operative position. The second hinge arm mounting structure is selectively movable from its operative position to its breakaway position against the biasing force exerted by the inner end of said breakaway lever and the spring.

In accordance with another aspect of the present development, a breakaway hinge receptacle includes a base including a first hinge arm mounting structure. A breakaway lever is movably connected to the base and includes inner and outer ends. The inner end defines or is connected to or otherwise includes a second hinge arm mounting structure that moves relative to the base between an operative position and a breakaway position when said breakaway lever moves relative to the base between first and second positions, the first position of the breakaway lever corresponding to the operative position of the second hinge arm mounting structure and the second position of the breakaway lever corresponding to the breakaway position of the second hinge arm mounting structure. A spring is operatively engaged between the breakaway lever and the base. The spring biases the breakaway lever to its first position in which the second hinge arm mounting structure is located in its operative position. The second hinge arm mounting structure is selectively movable against the biasing force of the spring from its operative position to its breakaway position by movement of the breakaway lever relative to the base from its first position to its second position.

DETAILED DESCRIPTION

Figure 1:
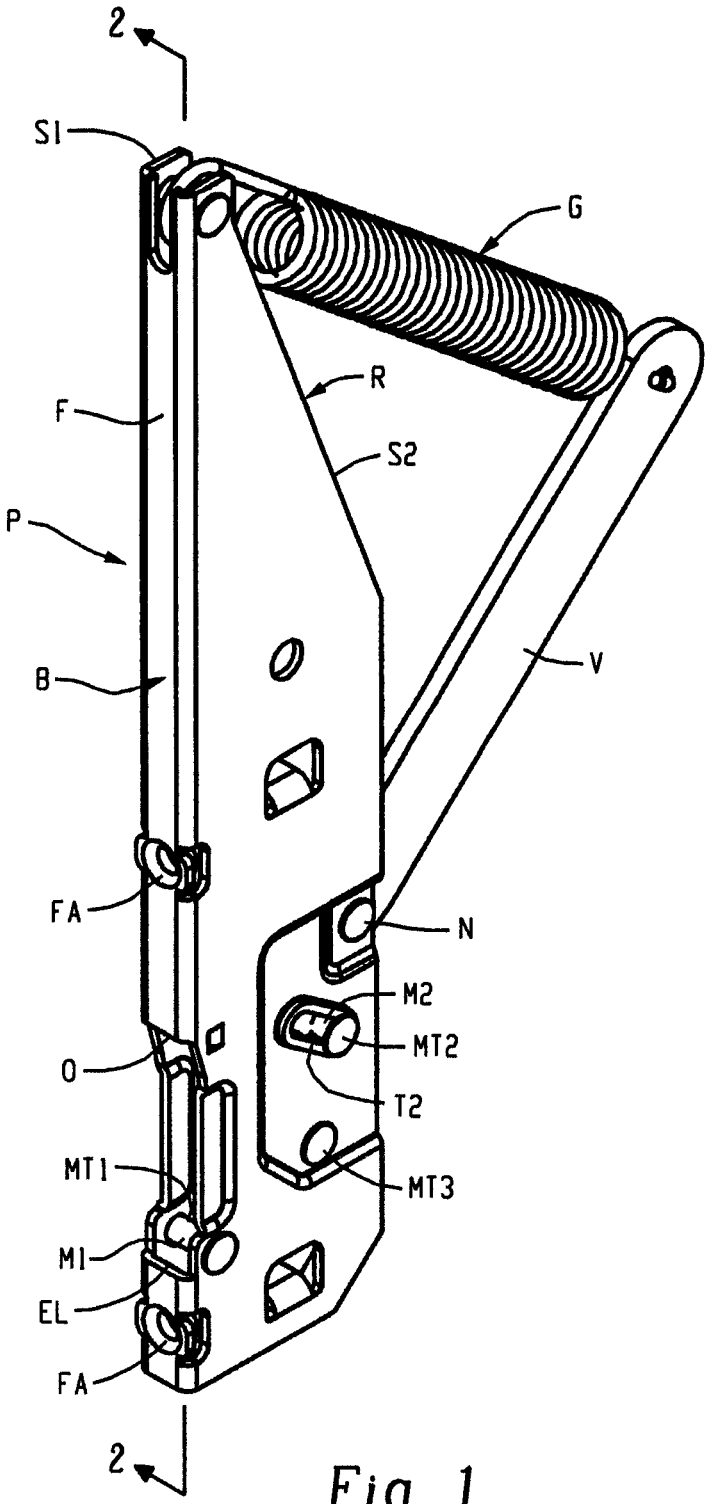
FIG. 1 is an isometric view of a breakaway hinge receptacle for an appliance door in accordance with a first embodiment.
Figure 2A:
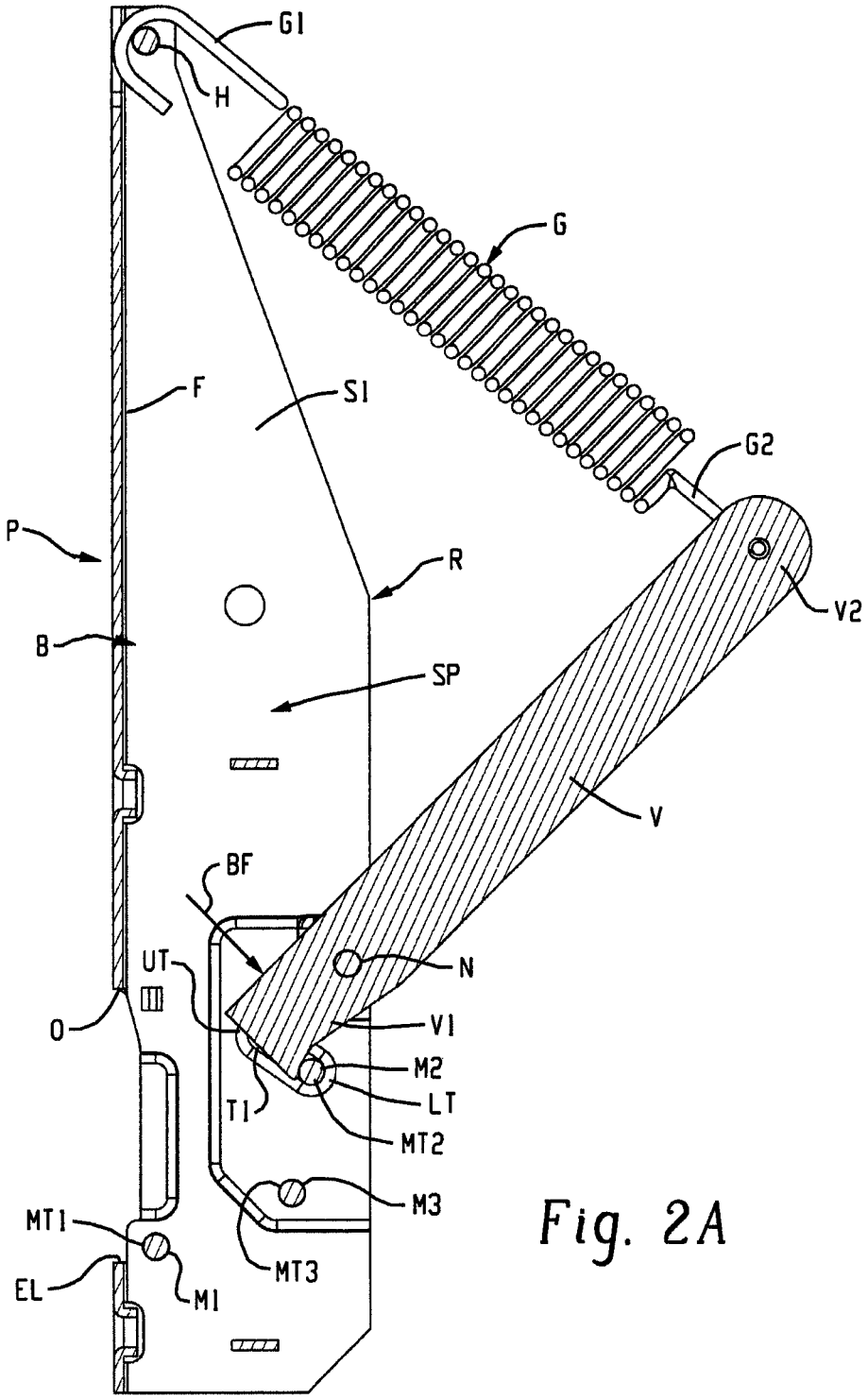
FIG. 2A is a section view as taken at line 2-2 of FIG. 1 showing the hinge receptacle in its operative state.
Figure 2B:
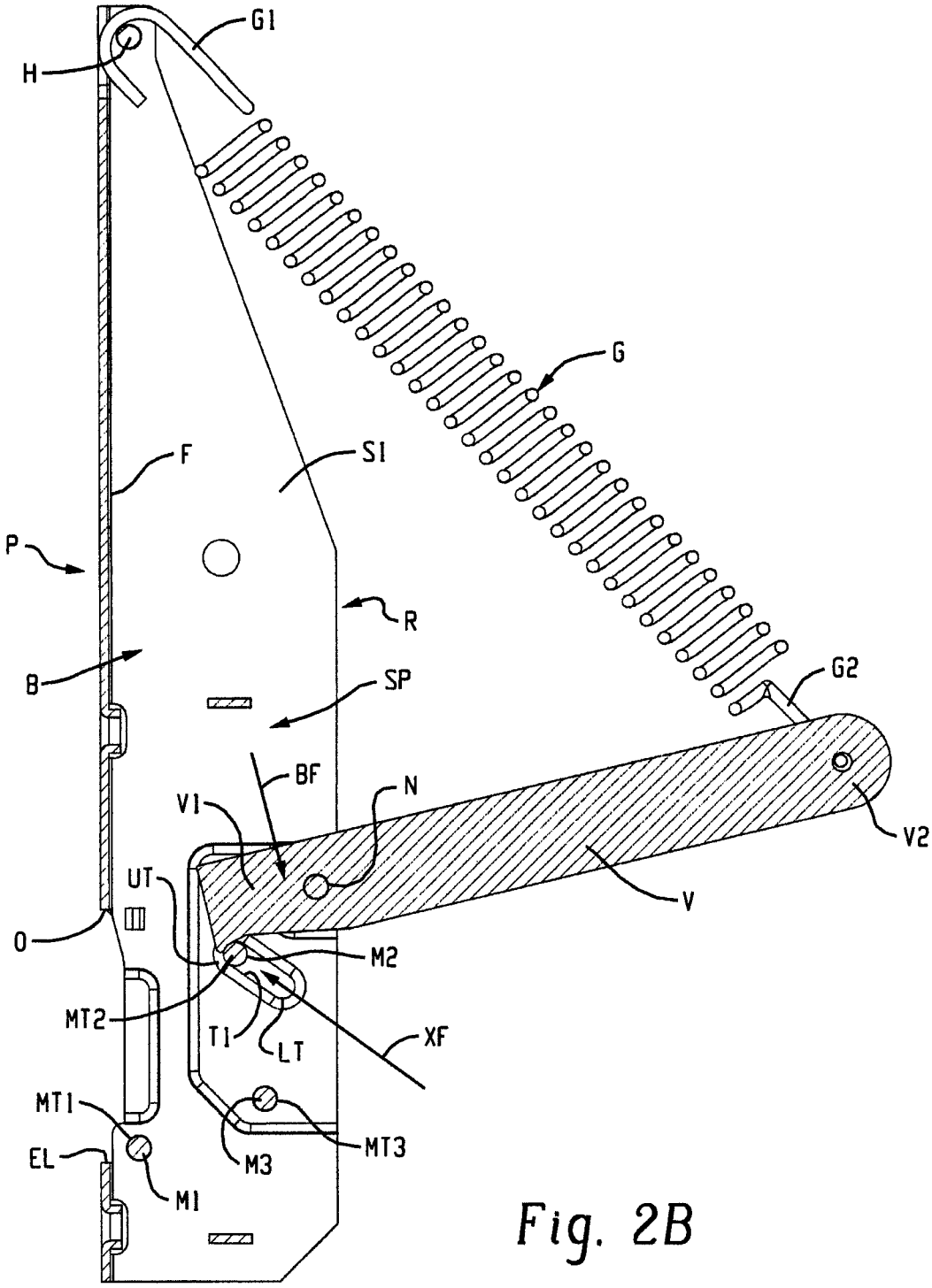
FIG. 2B is similar to FIG. 2A but shows the hinge receptacle in its breakaway state.

FIGS. 1, 2A and 2B show a first embodiment of a breakaway hinge receptacle for an appliance door, e.g., an oven door. The receptacle P includes a base B comprising first and second side walls S1,S2 connected by a front wall F so as to define a U-shaped cross-section with a rear region R that is completely or at least partially open to a space SP defined between the first and second side walls S1,S2 and front wall F. In FIGS. 2A and 2B, the second side wall S2 is removed to reveal the first side wall S1, the open rear region R and the space SP between the side walls S1,S2. The front wall F includes one or more aperture FA used for fastening the base B to an associated appliance frame/chassis.

Figure 3A:
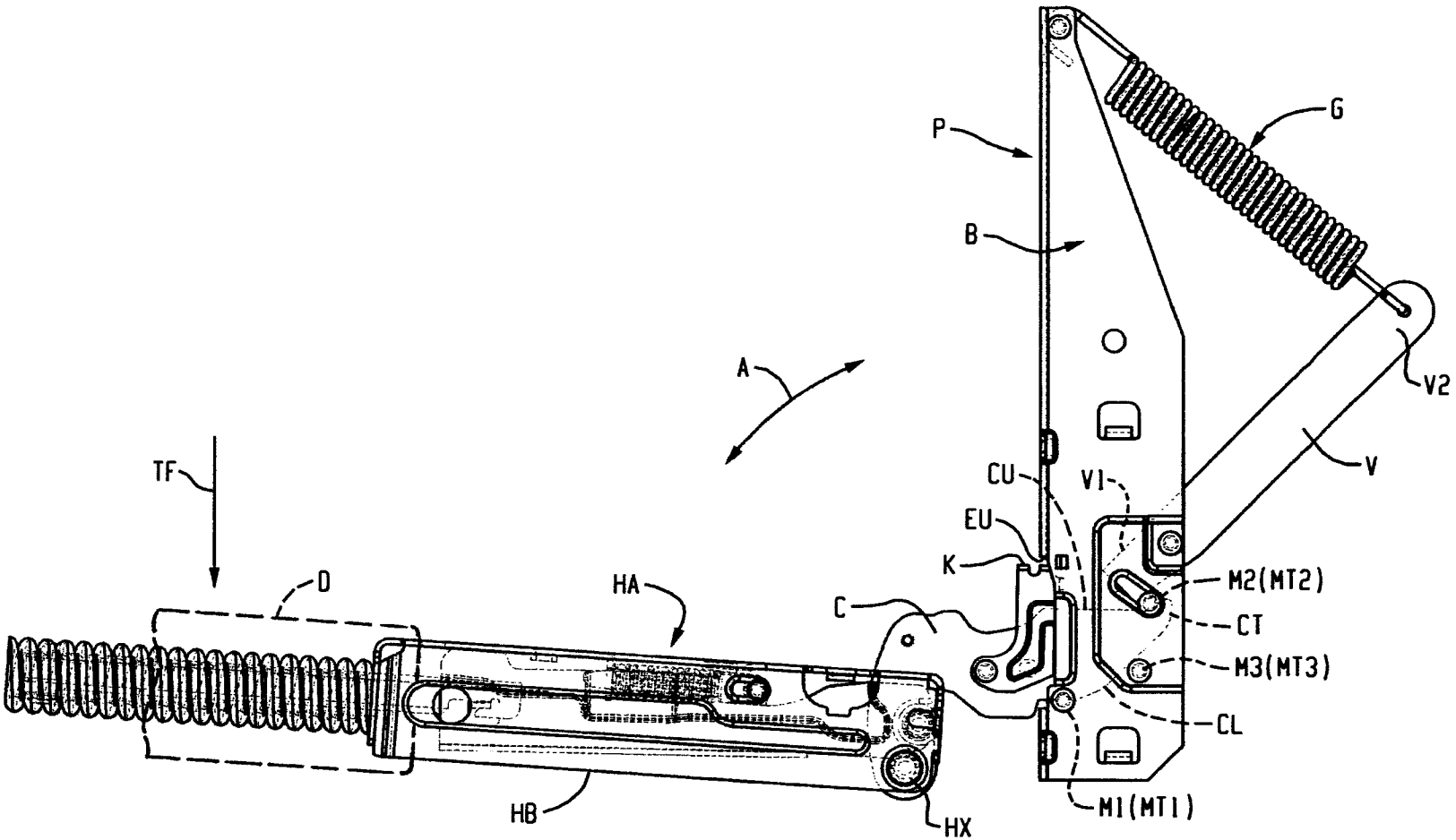
FIGS. 3A and 3B are side views that correspond respectively to FIGS. 2A and 2B and showing a hinge assembly mated with the hinge receptacle.

The receptacle P is adapted to mate with a claw or hinge arm C or like portion of a hinge assembly HA as shown in FIG. 3A. The exact mating arrangement can vary without departing from the overall scope and intent of the present development. In the illustrated embodiment, the front wall F of the receptacle P defines an opening O adapted to receive the hinge arm C of the hinge assembly HA therethrough. In the illustrated embodiment, the receptacle P comprises first and second mounting locations M1,M2 between which the hinge arm C is received and captured so that the hinge arm can be inserted and removed only by first lifting the hinge assembly HA and guiding a tip CT of the hinge arm C into the desired location between the mounting locations M1,M2 as shown in FIG. 3A. When installed, a lower edge CL of the hinge arm is supported on the first mounting location M1 and the opposite, upper edge CU of the hinge arm is abutted with the second mounting location M2. In the illustrated embodiment, a guide location M3 serves only to guide insertion of the hinge arm C into the receptacle P, but can alternatively be used to support the hinge arm C. The first and second mounting locations M1,M2 and the guide location M3 are defined by respective first, second and third rivets, pins, fasteners or other mounting structures MT1,MT2,MT3 that are connected to and/or that extend between the sidewalls across the space SP (the third mounting structure MT3 can alternatively be referred to as a "guide structure MT3" given the above-described function of guiding installation of the hinge arm C). As shown, the mounting structures MT1,MT2,MT3 are defined by respective rivets. In an alternative embodiment, the first and/or third mounting structures MT1,MT3, which are fixed in position, are defined by a portion of the receptacle base B, itself, e.g., a lower edge EL of the hinge arm opening O and/or a tab, projection, lip, wall or other parts of the base B adapted to support the lower edge CL of the hinge arm C. As shown in FIG. 1, the first mounting structure MT1 is defined by a rivet located adjacent the lower edge EL of the opening O. Preferably, the tip CT of the hinge arm C includes or defines an upturned lip other projection that lies behind and partially wraps/hooks around the second mounting structure MT2 when the hinge arm is fully mated with the receptacle P as shown in FIG. 3A. In an alternative embodiment, the hinge arm C includes a first slot and/or a second slot defined therein for respectively receiving and retaining the first and second mounting structures MT1,MT2 rather than being merely abutted therewith.

The second mounting structure MT2 is movably connected to the receptacle base B and moves between a normal or operative position and a breakaway position. In the illustrated embodiment, the second mounting structure MT2 is slidably connected to the receptacle base B for movement to and between its operative and breakaway positions. In particular, the first and second side walls S1,S2 defined respective first and second elongated slots T1,T2 that are aligned with each other. Opposite first and second ends of the second mounting structure MT2 are respectively located in the first and second slots T1,T2. The slots T1,T2 are arranged so that lower ends LT thereof are spaced vertically below and farther from the front wall F as compared to the upper ends UT for movement of the second mounting structure MT2 between its operative and breakaway positions as disclosed herein.

As shown in FIGS. 2A and 2B, the second mounting structure MT2 is normally biased into its operative position in the lower end LT of the slots T1,T2 (FIG. 2A), but is selectively movable against the biasing force BF to its breakaway position (FIG. 2B) in response to a breakaway force XF being exerted thereon by the hinge arm C. As shown herein, this biasing force BF is provided by a breakaway lever V that includes inner and outer ends V1,V2, and that is pivotally mounted, between its ends V1,V2, to the receptacle base B by a rivet or other pivot fastener N. The breakaway lever inner end V1 is abutted with or otherwise operative engaged with the second mounting structure MT2 and the breakaway lever outer end V2 is connected to or otherwise operative engaged with a spring G or other biasing structure. As shown, the spring G comprises a helically wound steel tension coil spring having a first end G1 connected to the receptacle base B (e.g., hooked around a rivet H or other fixed anchor location connected to/formed by the base) and a second end connected to the outer end V2 of the breakaway lever V (e.g., hooked through an aperture defined in the breakaway lever V) such that the spring G is operatively engaged between the base B and the outer end V2 of the breakaway lever V.

As shown in FIG. 2A, the inner end V1 of the breakaway lever urges the second mounting structure MT2 to its operative position due to the biasing force BF of the spring G on the outer end V2 of the breakaway lever. In response to sufficient breakaway force XF exerted on the second mounting structure MT2 by the hinge arm C, the second mounting structure MT2 moves in the slots T1,T2 from the lower ends LT at least partially toward and typically fully into the upper ends UT against the biasing force BF of the spring G, by pivoting the breakaway lever from its first or operative position (FIG. 2A) to its second or breakaway position (FIG. 2B) which causes the spring G to elongate resiliently. When the breakaway force XF is removed or subsides sufficiently, the spring G will resiliently shorten and pivot the breakaway lever V back to its first/operative position, which causes the inner end V1 of the lever V to move the second mounting structure MT2 back to its operative position in the lower ends LT of the slots T1,T2.

Operation of the hinge mounting receptacle P is further described with reference to FIGS. 3A & 3B. FIG. 3A shows the hinge assembly HA operatively mated with the receptacle P (typically an oven or other appliance door is mounted to the appliance body using a pair of hinge assemblies mated with respective receptacles P). The hinge arm C is captured between the first and second mounting structures MT1,MT2. The second mounting structure MT2 is biased by the spring G and lever V into its normal, operative position. The hinge assembly HA includes a latch K that is pivoted to its engaged position as shown in FIG. 3A where the latch K is located in abutment with or closely adjacent an upper edge EU of the opening O so as to prevent lifting of the hinge arm C away from the first mounting structure MT1 as required to separate the hinge arm C from the receptacle P. A body HB of the hinge assembly HA is adapted to pivot about a horizontal axis HX on an arc A between the fully opened position (FIG. 3A) and a closed position (not shown), where the hinge body HB is adjacent the receptacle body B. An oven or other door D is connected to the hinge body HB to move therewith on the arc A to open and close a cooking chamber or the like. It can be seen that the second mounting structure MT2 is engaged by the upturned hinge arm tip CT.

Figure 3B:
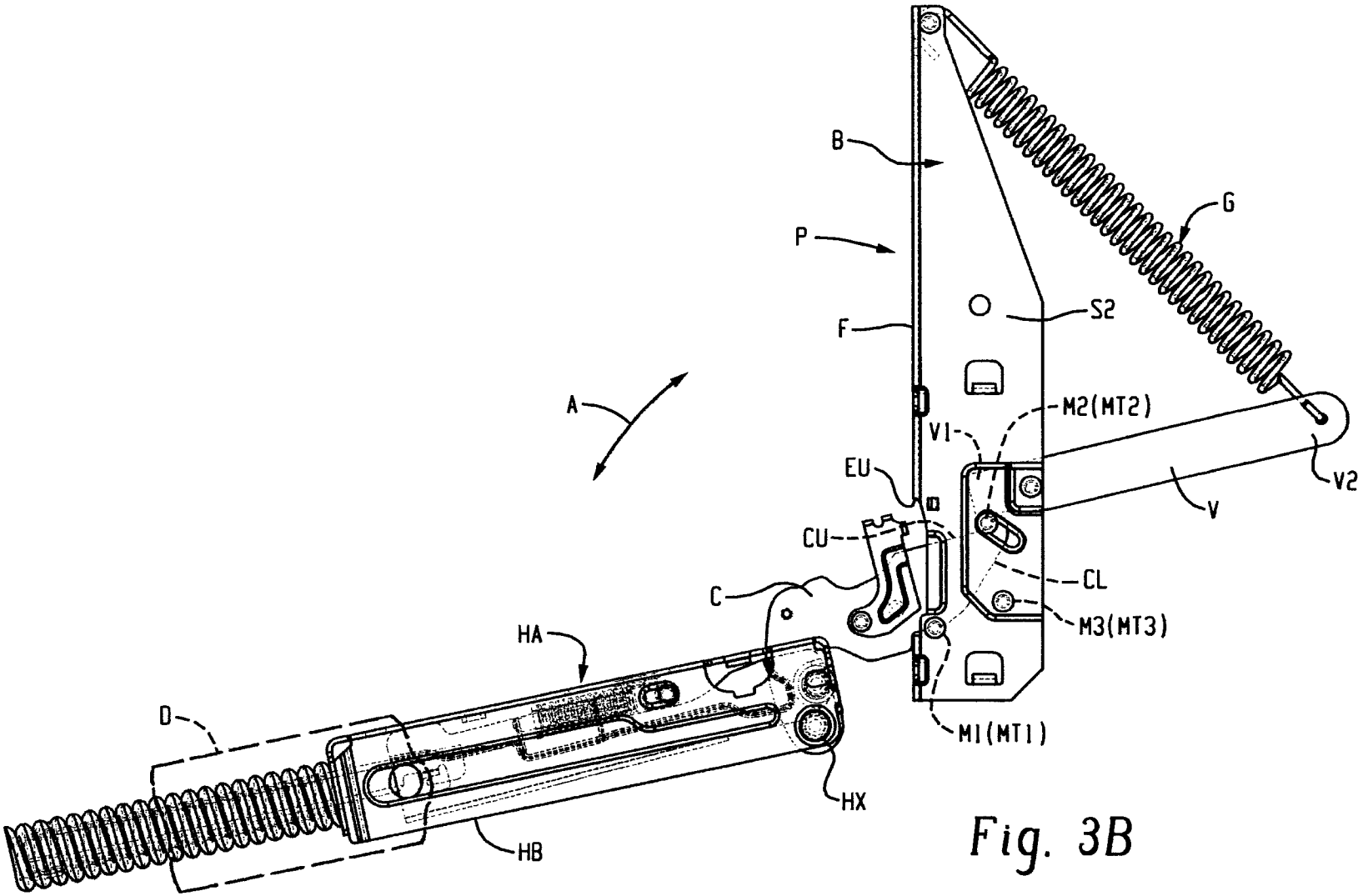

In case excessive weight or other tipping force TF is exerted on the door D that would damage the hinge assembly HA and/or mounting receptacle P or that would tip the related appliance, the tipping force TF causes the hinge arm C to rotate about the first mounting structure MT1 with sufficient breakaway force so that the hinge arm tip CT moves the second mounting structure MT2 from its operative position to its breakaway position as shown in FIG. 3B against the biasing force of the spring G and breakaway lever V. Rotation of the hinge arm C beyond the breakaway position is limited by the length of the slots T1,T2 and/or a stop that limits pivoting movement of the breakaway lever V and/or mounting structure MT2 or, alternatively, no stop is provided in the receptacle P and the final breakaway position is defined when the oven door D contacts the floor on which the oven is supported. The breakaway action of the mounting receptacle P will serve to signal to a user that excessive tipping force TF is being exerted on the door D and will also serve to inhibit tipping of the appliance while absorbing some or all of the tipping force TF. Also, the receptacle P automatically resets to the operative position (FIG. 3A) when the tipping force TF is removed or at least subsides below a threshold that will vary depending on the strength of the spring G, length of the breakaway lever V and other structural variations. As noted above, in an alternative embodiment, the first mounting structure MT1 is provided by the lower edge EL or other part of the base B and, in such case, the tipping force TF causes the hinge arm C to rotate about the lower edge EL or other part of the base B with sufficient breakaway force so that the hinge arm tip CT moves the second mounting structure MT2 from its operative position to its breakaway position.

Figure 4:
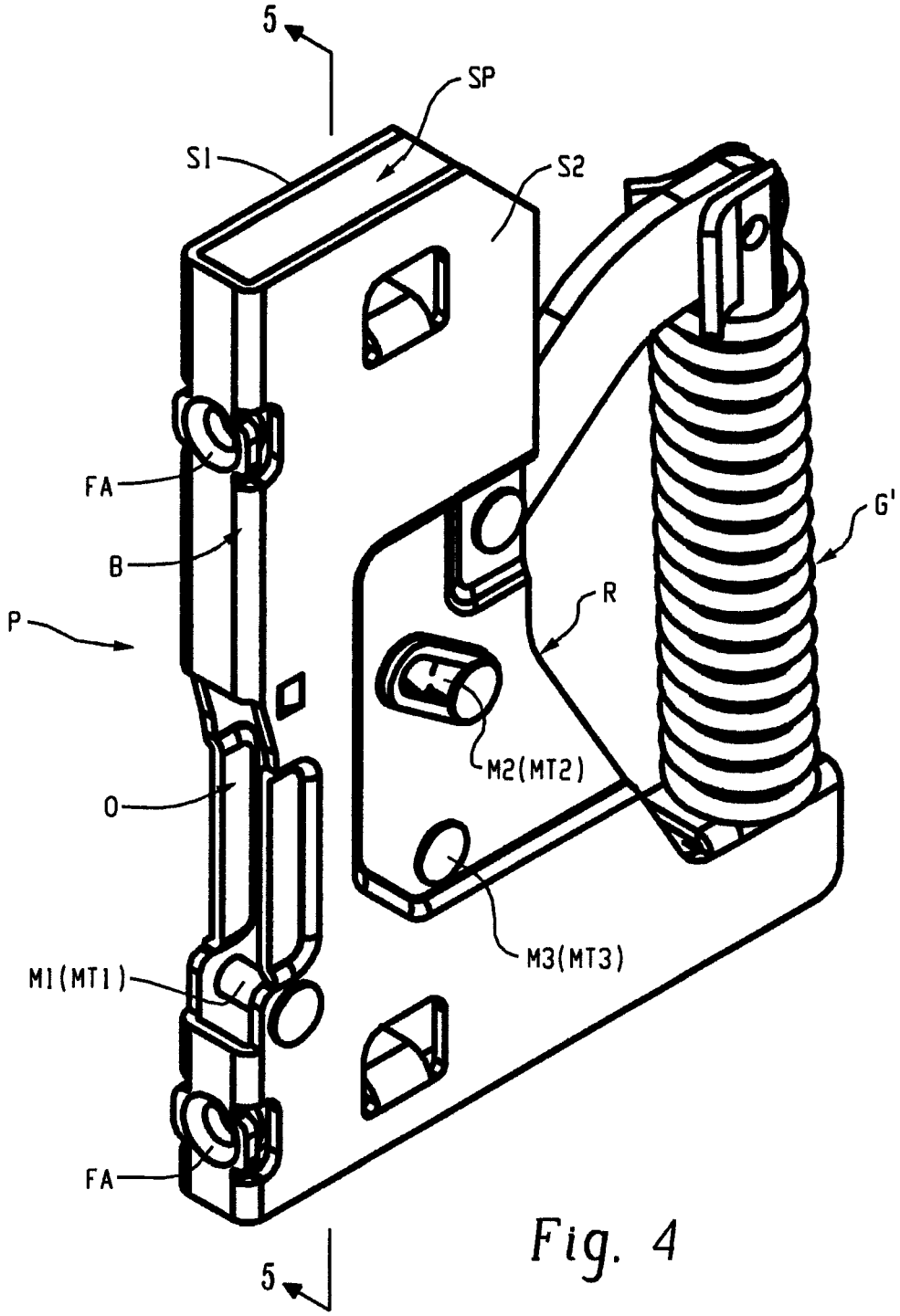
FIG. 4 is an isometric view of a breakaway hinge receptacle for an appliance door in accordance with a second embodiment.
Figure 5A:
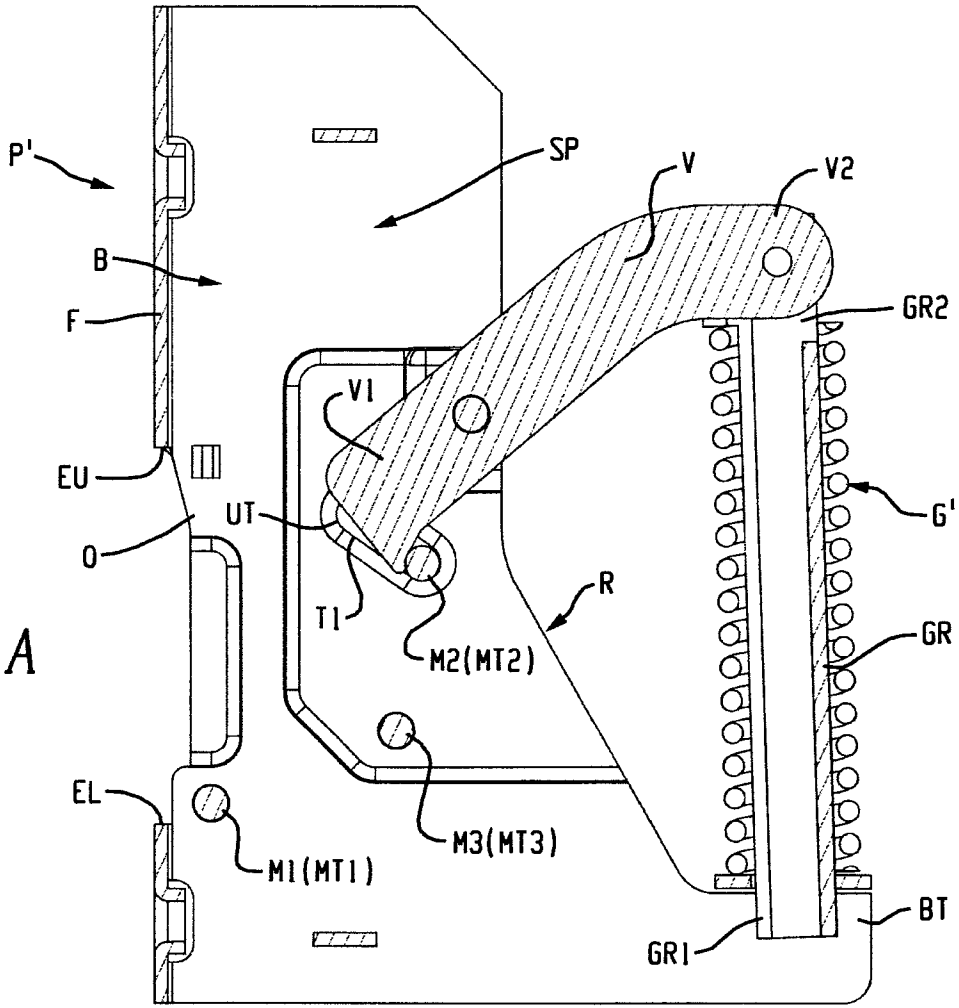
FIG. 5A is a section view as taken at line 5-5 of FIG. 4 showing the hinge receptacle in its operative state.
Figure 5B:
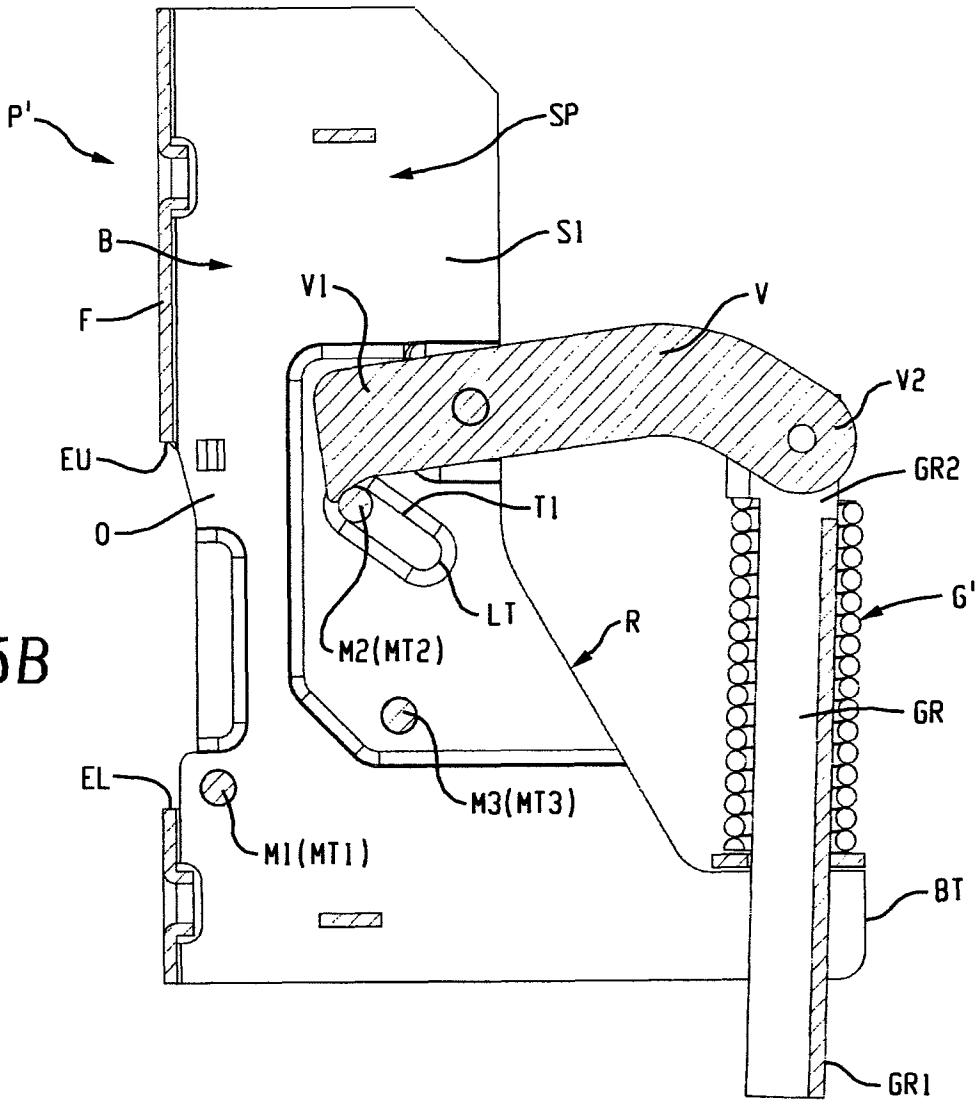
FIG. 5B is similar to FIG. 5A but shows the hinge receptacle in its breakaway state.

FIGS. 4, 5A and 5B illustrate another embodiment of a breakaway hinge receptacle P' formed in accordance with the present development. Like components and/or features relative to the breakaway hinge receptacle P are identified with like reference numbers/characters. The general structure and operation of the breakaway hinge receptacle P' is identical to the breakaway hinge receptacle P.

A main distinction is that the hinge receptacle P' uses a compression biasing spring G' in place of the tension biasing spring G. In particular, the compression biasing spring G' is a helically wound coil spring that is coaxially mounted about a spring rod GR. The spring rod R includes a first end GR1 that is slidably engaged with a projecting tail BT of the receptacle base B. The spring rod GR further includes a second end GR2 that is pivotally secured to the outer end V2 of the breakaway lever V. The coaxially mounted compression spring G' is captured on the spring rod GR and normally biases the outer end V2 of the breakaway lever V upwardly/outwardly away from the projecting tail BT of the receptacle base which, in turn, causes the inner end V1 of the breakaway lever V to bias the second mounting structure MT2 to its normal, operative position as described above for the breakaway hinge receptacle P. In response to the breakaway force XF exerted on the second mounting structure MT2 by the hinge arm C (as described above), the second mounting structure MT2 moves in the slots T1,T2 from the lower ends LT at least partially toward and typically fully into the upper ends UT against the biasing force of the spring G', by pivoting the breakaway lever V from its operative position (FIG. 5A) to its breakaway position (FIG. 5B) which causes the spring G' to be resiliently compressed on the spring rod GR between the outer end V2 of the breakaway lever V and the projecting tail BT of the receptacle base B. When the breakaway force XF is removed or subsides sufficiently, the spring G' will resiliently elongate and pivot the breakaway lever V back to its operative position, which causes the inner end V1 of the lever V to move the second mounting structure MT2 back to its operative position in the lower ends LT of the slots T1,T2.

Figure 6A:
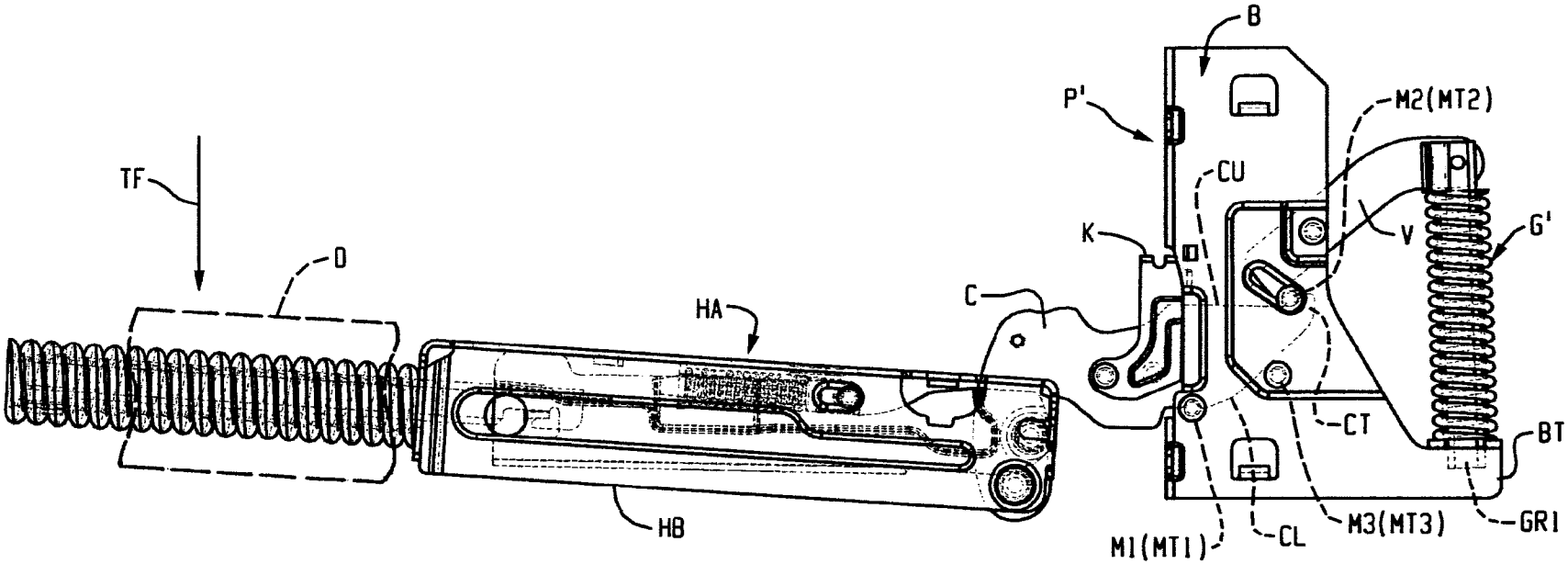
FIGS. 6A and 6B are side views that correspond respectively to FIGS. 5A and 5B and showing a hinge assembly mated with the hinge receptacle.
Figure 6B:
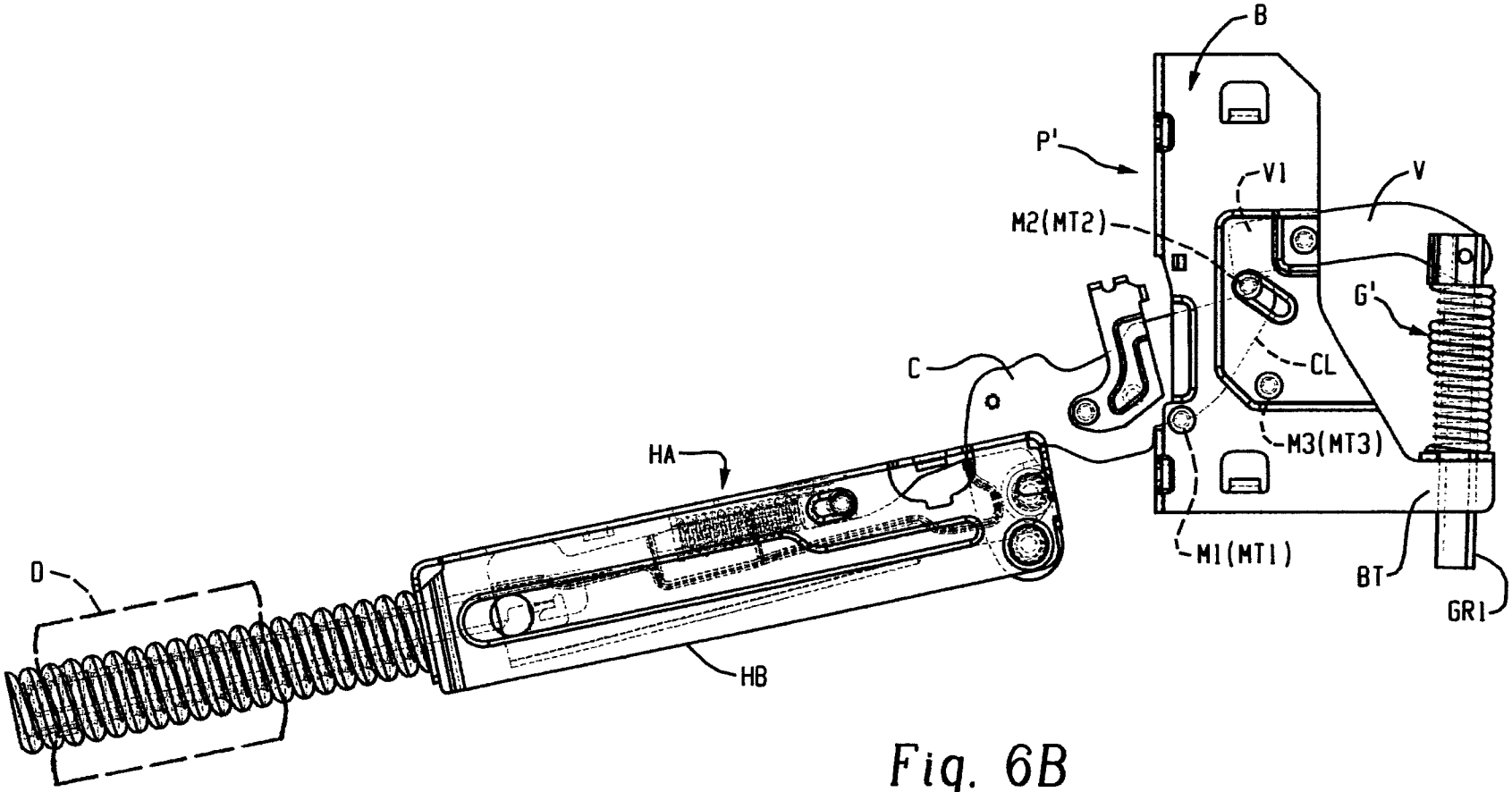

FIGS. 6A and 6B correspond respectively to FIGS. 3A and 3B, except that the hinge assembly HA is shown mated with the receptacle P' rather than the receptacle P. The hinge arm C mates with the receptacle P' in the same manner as for the receptacle P as shown in FIG. 6A, and, as shown in FIG. 6B, the breakaway function for the receptacle P' corresponds exactly to the receptacle P, except that the compression spring G' is operative to bias the second mounting structure MT2 to its normal operative position as just described, rather than the tension spring G of the receptacle P.

Figure 7A:
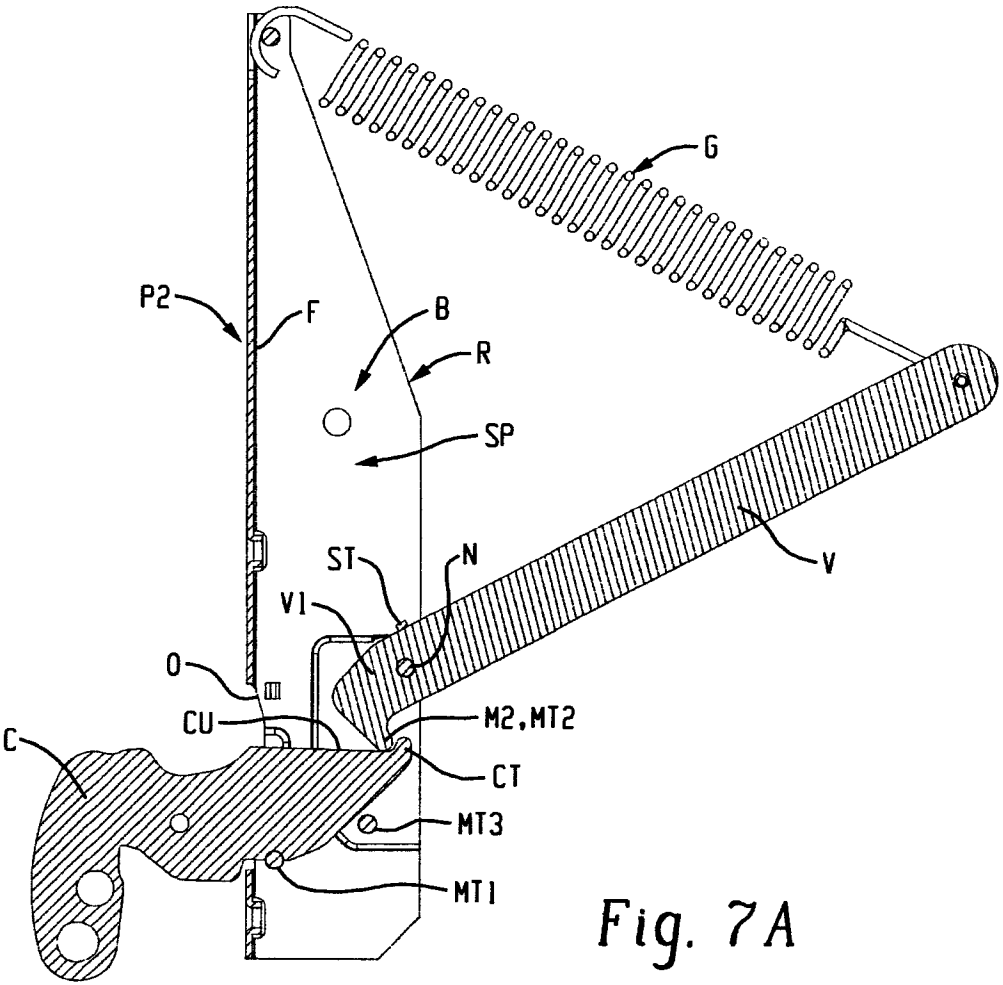
FIGS. 7A and 7B are section views of another alternative hinge receptacle in its operative and breakaway states, respectively, and showing a hinge arm of a hinge assembly mated therewith.
Figure 7B:
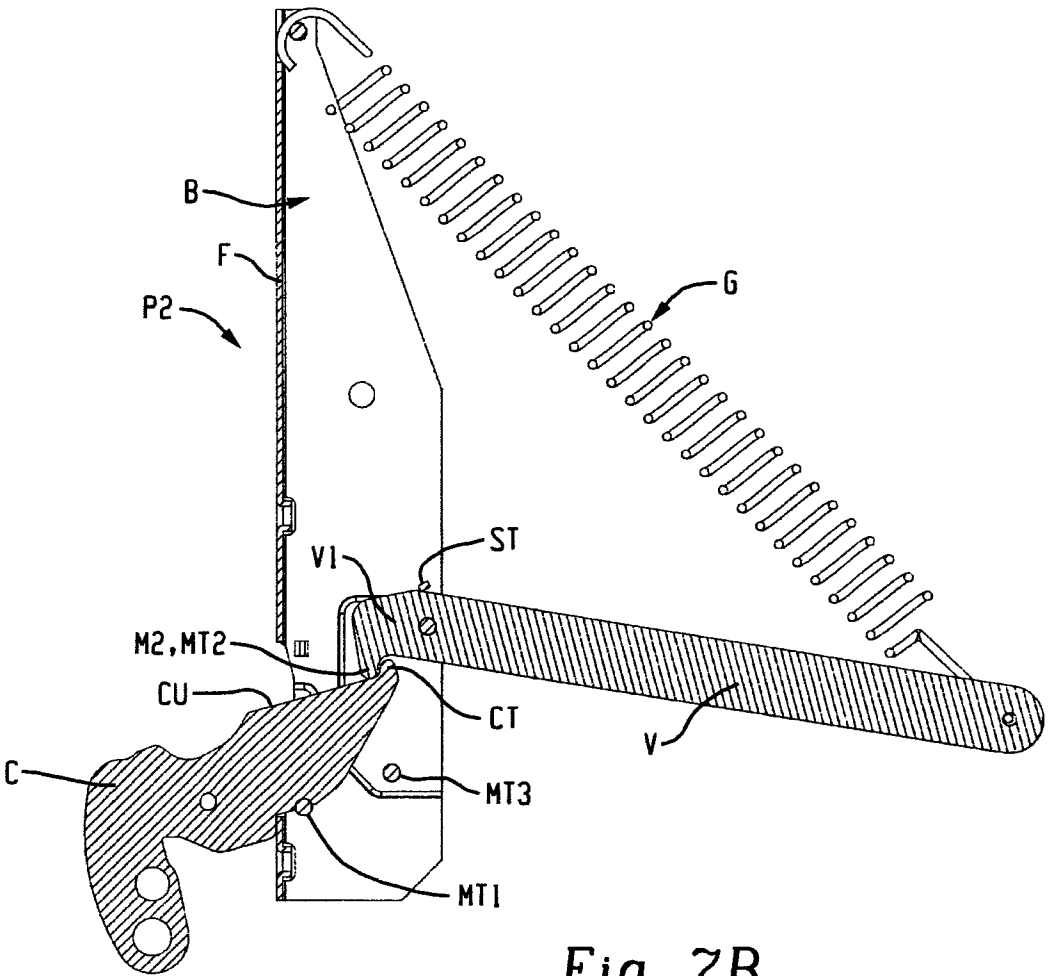
Figure 9:
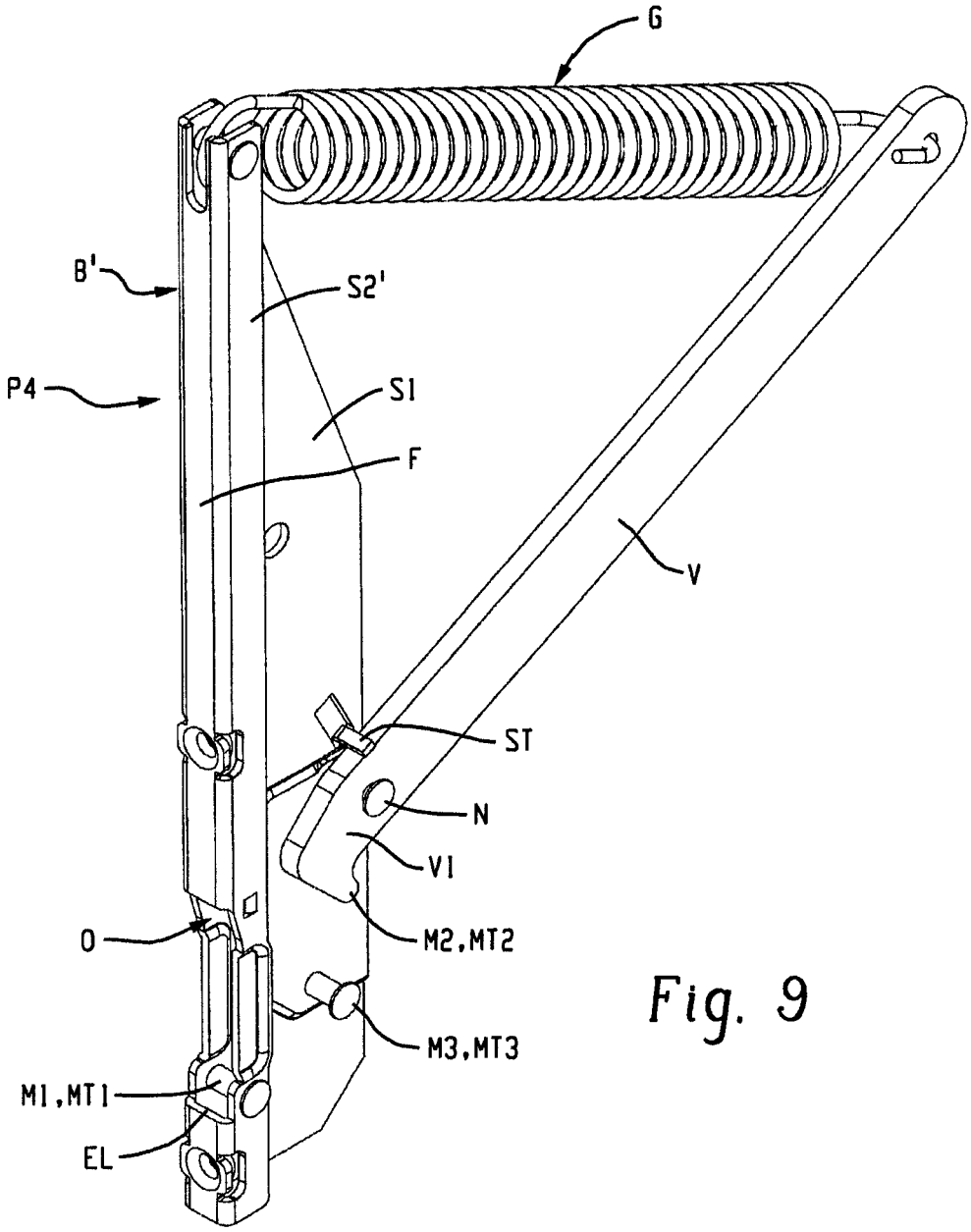
FIG. 9 is an isometric view of another alternative breakaway hinge receptacle.

FIGS. 7A and 7B are sectional views that correspond respectively to FIGS. 2A and 2B, but that also show a hinge arm C mated with a breakaway receptacle P2 that is identical to the breakaway receptacle P, except that the second mounting location M2 and second mounting structure MT2 are instead defined as part of or are connected to or are otherwise included on the inner end V1 of the breakaway lever V. In such case, the upper edge CU of the hinge arm C is abutted directly with the inner end V1 of the breakaway lever V, e.g., with the upturned tip CT of the hinge arm C abutted with the second mounting location M2 defined by the inner end V1 of the breakaway lever V. The breakaway hinge receptacle 2P also includes a stop ST defined by and/or connected to the base B for limiting movement of the breakaway lever V between its operative (FIG. 7A) and its breakaway positions (FIG. 7B). As shown the stop ST is defined by a projecting tab of the base B, but a shoulder rivet or other structure can be connected to the base B if desired to provide the stop ST. In such case, the single stop ST limits the angular motion of the breakaway lever V about the pivot fastener N in both directions so as to define both the operative and breakaway positions for the breakaway lever V. Alternatively, the stop ST can be positioned to stop movement of the hinge arm C away from its operative position beyond a certain extent so as to define the breakaway position for the hinge arm C rather than for the breakaway lever V. Those of ordinary skill in the art will recognize that, in the alternative embodiment of FIGS. 7A and 7B, the base B need not be U-shaped in cross-section and can instead have any desired shape that provides a location for pivotally connecting the breakaway lever V thereto using the pivot fastener N or other means (an example of an alternative base B is shown in FIG. 9 and described further below). In one embodiment, no stop is provided to control/set the breakaway position of the breakaway lever V or hinge arm C, in which case during a breakaway condition, the hinge arm C and lever V will rotate until the oven door D contacts the floor or other obstruction.

Figure 8A:
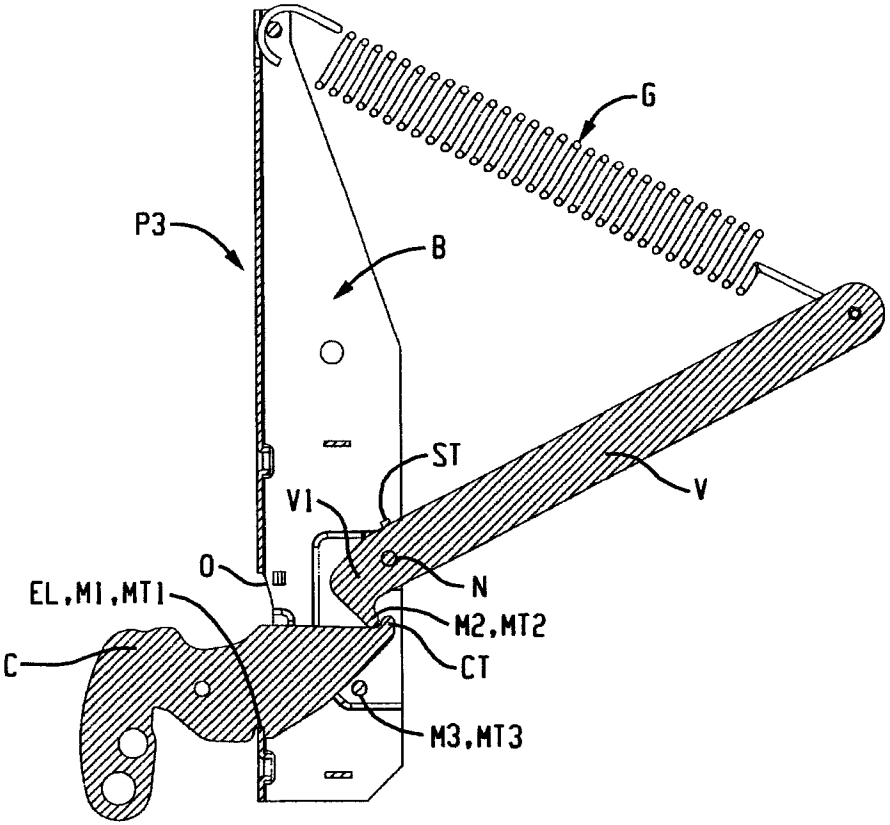
FIGS. 8A and 8B correspond respectively to FIGS. 7A and 7B but show a modified version of the hinge receptacle.
Figure 8B:
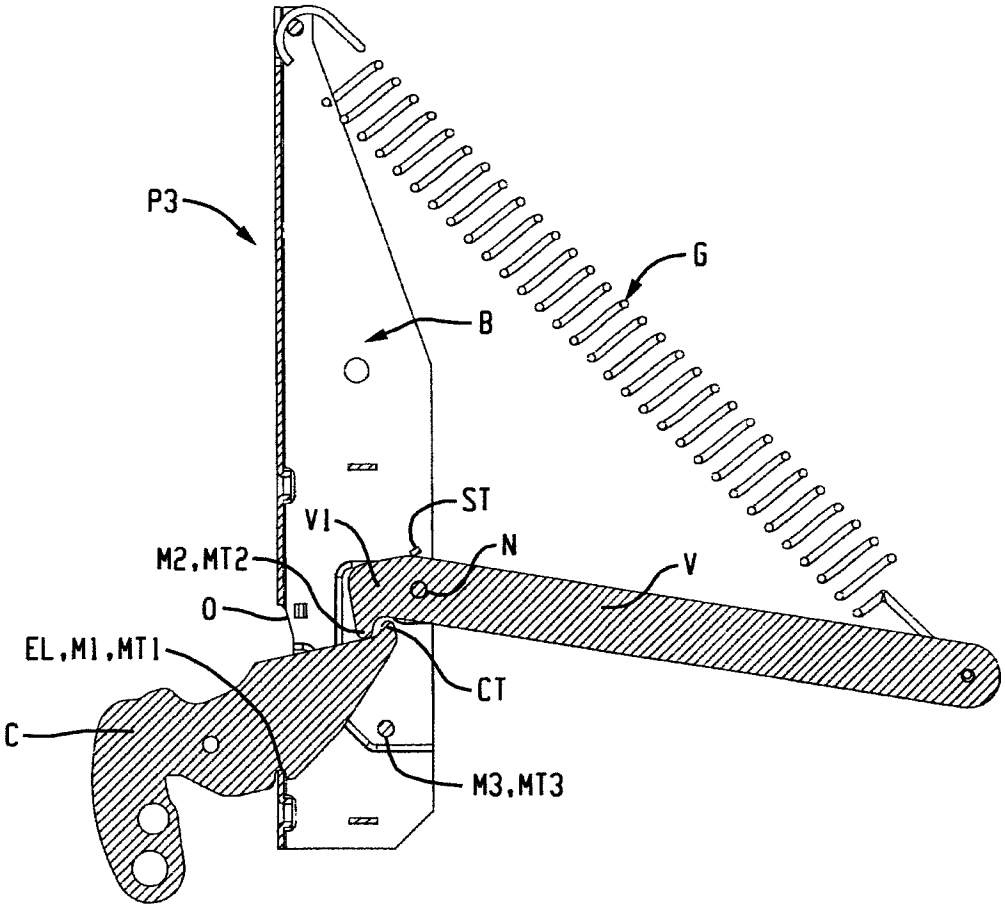

FIGS. 8A and 8B correspond respectively to FIGS. 7A and 7B but show another alternative embodiment of a breakaway hinge receptacle P3 that is identical to the breakaway hinge receptacle 2P except that the lower edge EL of the hinge arm opening O defines the first mounting structure MT1 in place of a rivet or other fastener. In such case, the hinge arm C preferably includes or defines a slot or other location CS that is adapted to receive the lower edge EL of the opening O and allows for pivoting movement of the hinge arm C between its operative position (FIG. 8A) and its breakaway position (FIG. 8B). Although shown as a rivet, the third mounting structure MT3, which serves to guide installation of the hinge arm C into the receptacle P3, can be defined by a tab or other portion of the base B.

FIG. 9 is an isometric view of another alternative breakaway hinge receptacle P4 that is identical to the breakaway hinge receptacle P2, except that the side wall S2 of the base B has been substantially removed to define a base B' comprising the side wall S1, the front wall F, and a side wall S2' that is substantially shorter than the sidewall S1 (in terms of projection perpendicularly away from the front wall F) but that is long enough to allow the first mounting structure (rivet) MT1 to be connected between the side walls S1 and S2'. In the illustrated example, the third mounting structure MT3 is provided by a shoulder rivet or other structure connected only to the first side wall S1, or can alternatively be provided or defined by a projecting part of the side wall S1, itself. Likewise, the breakaway lever V is pivotally connected only to the side wall S1 by a shoulder rivet or other pivot fastener N.

Those of ordinary skill in the art will recognize that the base B' can also be used in the breakaway hinge receptacle P3 in place of its base B. In such case, the base B' can be defined as shown or, alternatively, the entire side wall S2 can be removed given that the lower edge EL of the hinge arm opening O is used to define the first mounting structure MT1.

Figure 10A:
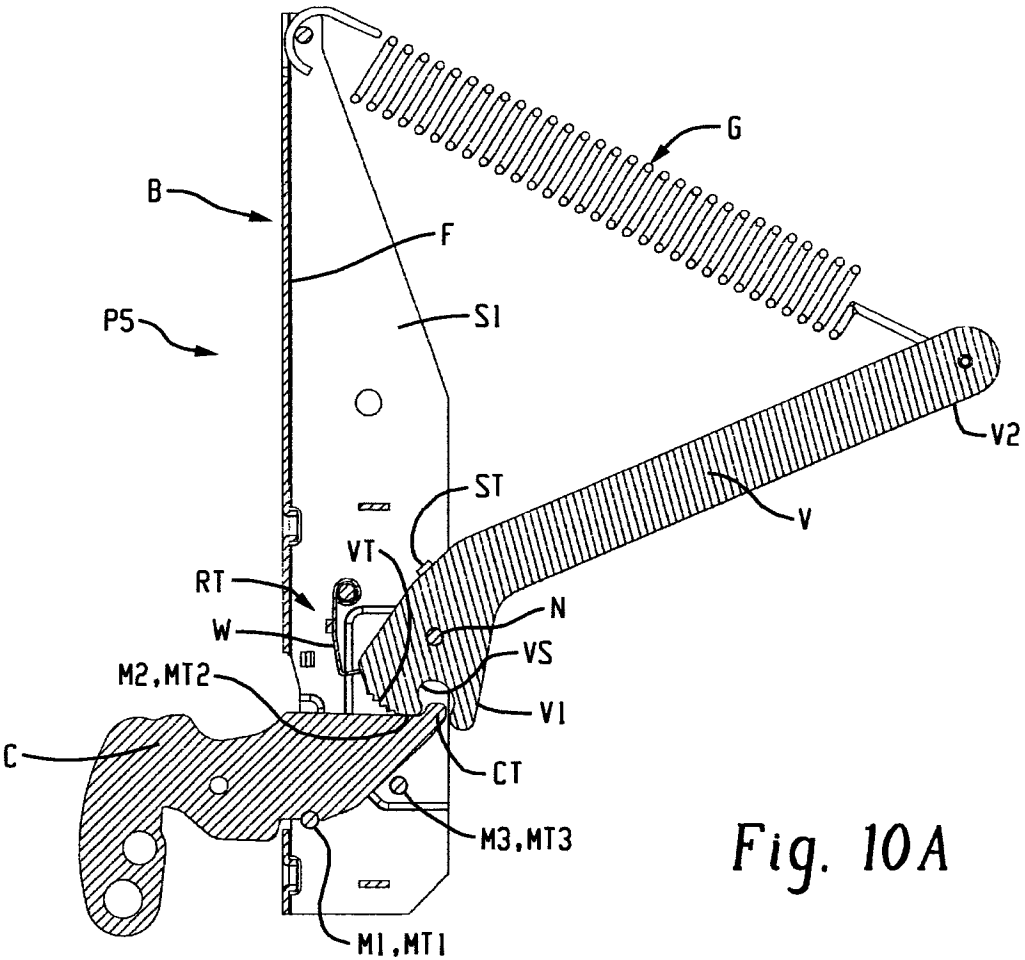
FIGS. 10A and 10B show another hinge receptacle in its operative and breakaway states, respectively, that is similar to the embodiment of FIGS. 7A and 7B, but further includes a lock mechanism.
Figure 10B:
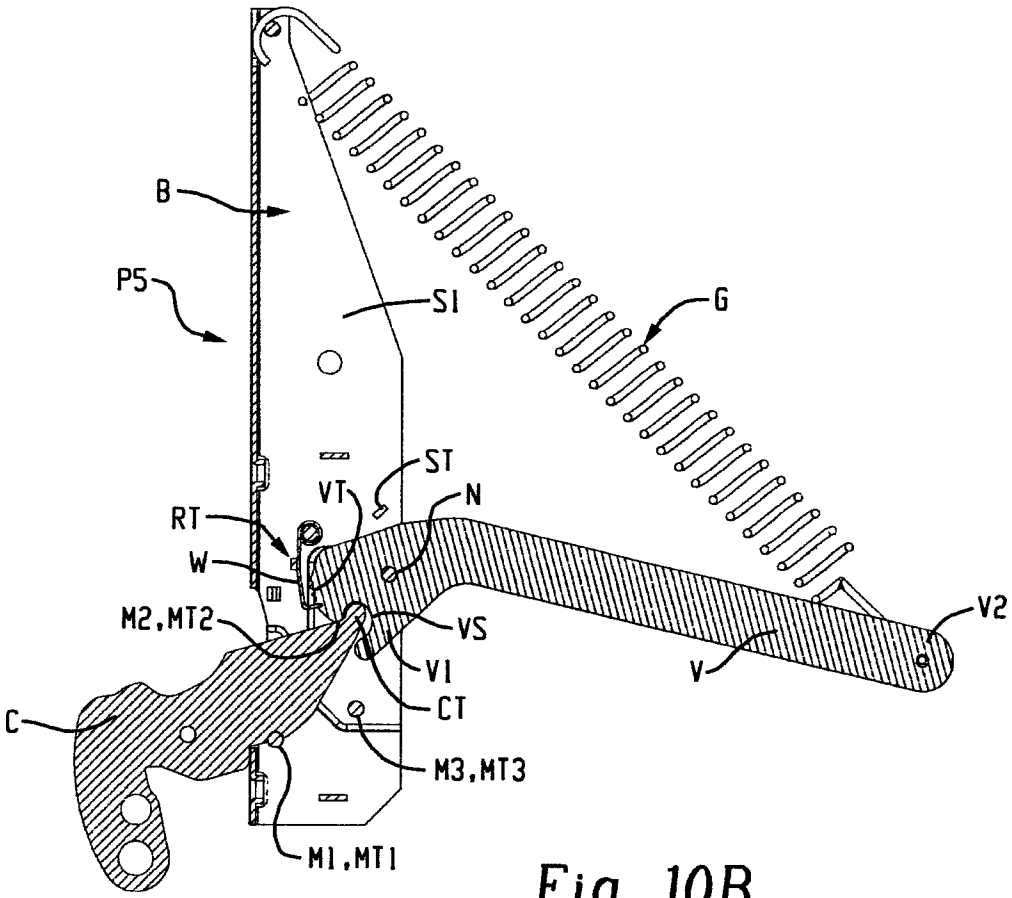

Any of the breakaway receptacles P,P', P2,P3,P4 can include a lock or lock mechanism or means for locking the breakaway lever V and/or hinge arm C in their respective breakaway positions until the breakaway receptacle is reset by the end-user or a technician. In one such embodiment, as shown at 5P in FIGS. 10A and 10B, a ratchet or detent mechanism RT is provided to allow breakaway the hinge arm C and/or lever V to move from their respective operative positions to their respective breakaway positions and to prevent movement the hinge arm C and/or lever V from their respective breakaway positions to their respective operative positions. In such case, the ratchet or detent mechanism can be reset using a tool or can be configured to reset automatically when the end-user or technician pivots the oven door D to its closed position. In the illustrated embodiment, the inner end V1 of the breakaway lever V defines the second mounting location M2 and second mounting structure MT2 for engaging the tip CT of the hinge arm C. In particular, the inner end V1 of the breakaway lever V defines a notch or slot VS in which the tip CT of the hinge arm is received. The inner end V1 of the breakaway lever V also includes one or more teeth VT. A resilient pawl W, such as defined by a resilient wire or the like, is connected to the base B (or B') and abuts the inner end V1 of the breakaway lever V. As shown in FIG. 10B, when the hinge arm C and breakaway lever V move to their breakaway positions, the pawl W engages the one or more teeth T in a ratchet-like manner, and the pawl W prevents the biasing force of the spring G from returning of the breakaway lever V and hinge arm C to their operative positions. Instead, a user or technician must manually force the hinge arm C toward its operative position (e.g. by closing the oven door and pushing on same) and overcome the strength of the pawl W by resiliently deflecting the pawl out of engagement with the one or more teeth T so that the hinge arm and breakaway lever V can move back to their operative positions to reset the breakaway hinge receptacle 5P for use again. The position of the tip CT of the hinge arm C in the notch VS allows the hinge arm C to urge the breakaway lever from its breakaway position to its operative position. The resilient nature of the pawl W is such that it will not be damaged by multiple breakaway or reset operations.

Those of ordinary skill in the art will recognize that any of the breakaway receptacles P2, P3,P4,P5 can be implemented using the compression spring G' and related components as shown in FIGS. 4, 5A and 5B.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A breakaway hinge receptacle comprising:

a base including first and second hinge arm mounting structures, said second hinge arm mounting structure movable between an operative position and a breakaway position;

a breakaway lever connected to the base and including inner and outer ends, wherein said inner end is operatively engaged with said second hinge arm mounting structure;

a spring operatively engaged between said breakaway lever and said base, said spring biasing said breakaway lever to a first position in which said inner end of said breakaway lever biases said second mounting structure to its operative position;

wherein said second hinge arm mounting structure is selectively movable from its operative position to its breakaway position against said biasing force exerted by said inner end of said breakaway lever and said spring.

2. The breakaway receptacle as set forth in claim 1, wherein said breakaway lever is pivotally connected to said base between its inner and outer ends.

3. The breakaway receptacle as set forth in claim 2, wherein said spring comprises either a tension spring or a compression spring.

4. The breakaway receptacle as set forth in claim 3, wherein said base includes first and second side walls and wherein said second mounting structure extends between and is connected to said first and second side walls, said first and second side walls comprising respective first and second elongated slots with which opposite first and second ends of the second mounting structure are respectively engaged.

5. The breakaway receptacle as set forth in claim 4, wherein said base comprises a front wall that extends between said first and second side walls, and wherein said first and second slots have respective lower ends that are located vertically below respective upper ends, the lower end of each slot is farther from said front wall as compared to the upper end of the slot.

6. The breakaway receptacle as set forth in claim 5, wherein said inner end of said breakaway lever is located between said first and second side walls.

7. The breakaway receptacle as set forth in claim 5, wherein said front wall of said base includes an opening adapted for receipt of an associated hinge arm, and wherein said first mounting structure is located adjacent a lower edge of said opening.

8. The breakaway receptacle as set forth in claim 5, wherein said first mounting structure comprises a portion of said base that defines a lower edge of said opening.

9. The breakaway receptacle as set forth in claim 3, wherein said spring comprises a tension spring that is connected to and extends between said outer end of said breakaway lever and said base.

10. The breakaway receptacle as set forth in claim 3, wherein said base comprises a projecting tail, and wherein said spring comprises a compression spring coaxially located about a spring rod, said spring rod including: (i) a first end slidably engaged with said projecting tail; and, (ii) a second end pivotally connected to said outer end of said breakaway lever.

11. A breakaway hinge receptacle comprising:

a base including a first hinge arm mounting structure;

a breakaway lever movably connected to the base and including inner and outer ends, wherein said inner end includes a second hinge arm mounting structure that moves relative to said base between an operative position and a breakaway position when said breakaway lever moves relative to said base between first and second positions, said first position of said breakaway lever corresponding to said operative position of said second hinge arm mounting structure and said second position of said breakaway lever corresponding to said breakaway position of said second hinge arm mounting structure;

a spring operatively engaged between said breakaway lever and said base, said spring biasing said breakaway lever to its first position in which said second hinge arm mounting structure is located in its operative position;

said second hinge arm mounting structure selectively movable against said biasing force of said spring from its operative position to its breakaway position by movement of said breakaway lever relative to said base from its first position to its second position.

12. The breakaway receptacle as set forth in claim 11, wherein said breakaway lever is pivotally connected to said base between its inner and outer ends.

13. The breakaway receptacle as set forth in claim 12, wherein said spring comprises either a tension spring or a compression spring.

14. The breakaway receptacle as set forth in claim 13, wherein said base includes first and second side walls between which said inner end of said breakaway lever is located.

15. The breakaway receptacle as set forth in claim 14, wherein said base comprises a front wall that extends between said first and second side walls, wherein said front wall includes an opening adapted for receipt of an associated hinge arm, and wherein said first mounting structure is located adjacent a lower edge of said opening.

16. The breakaway receptacle as set forth in claim 15, wherein said first mounting structure comprises a portion of said base that defines a lower edge of said opening.

17. The breakaway receptacle as set forth in claim 13, wherein said spring comprises a tension spring that is connected to and extends between said outer end of said breakaway lever and said base.

18. The breakaway receptacle as set forth in claim 13, wherein said base comprises a projecting tail, and wherein said spring comprises a compression spring coaxially located about a spring rod, said spring rod including: (i) a first end slidably engaged with said projecting tail; and, (ii) a second end pivotally connected to said outer end of said breakaway lever.

19. The breakaway receptacle as set forth in claim 11, further comprising a lock for holding said breakaway lever in its second position against said biasing force of said spring.

20. The breakaway receptacle as set forth in claim 19, wherein said lock comprises:

at least one tooth defined by said inner end of said breakaway lever; and, a resilient pawl connected to the base and adapted to selectively engage and retain said at least one tooth when said breakaway lever moves from its first position to its second position.

21. The breakaway receptacle as set forth in claim 11, wherein said base comprises:

a front wall including an opening adapted for insertion of an associated hinge arm therethrough;

a first side wall that projects outwardly from said front wall, wherein said breakaway lever is pivotally connected only to said first side wall.

22. The breakaway receptacle as set forth in claim 21, wherein said base further comprises a second side wall that projects from said front wall, wherein said first mounting structure is connected to both said first and second side walls.

* * * * *